US005698258A

United States Patent [19]

Takizawa et al.

[11] Patent Number: 5,698,258

[45] Date of Patent: Dec. 16, 1997

[54] METHOD OF PRODUCING A CATHODE-RAY TUBE INCLUDING FIRST AND SECOND TRANSPARENT LAYERS OF HIGH AND LOW REFRACTIVE INDICES FORMED ON A FACE PLATE TO THEREBY LOWER ELECTROMAGNETIC WAVE EMISSION AND REDUCE EXTERNAL LIGHT REFLECTION

[75] Inventors: Tomoki Takizawa; Hiroshi Okuda, both of Nagaokakyo, Japan

[73] Assignee: Mitsubishi Denki Kabushiki Kaisha, Kyoto, Japan

[21] Appl. No.: 449,820

[22] Filed: May 24, 1995

Related U.S. Application Data

[62] Division of Ser. No. 70,898, Jun. 3, 1993, abandoned.

[30] Foreign Application Priority Data

Jun. 4, 1992 [JP] Japan ..... 4-144089

[51] Int. Cl.[6] ..... B05D 5/06

[52] U.S. Cl. ..... 427/64; 427/165; 427/166; 427/226; 427/248.1; 427/419.2; 427/68

[58] Field of Search ..... 427/64, 68, 226, 427/165, 419.2, 166, 248.1

[56] References Cited

U.S. PATENT DOCUMENTS

| | | | |
|---|---|---|---|
| 3,991,228 | 11/1976 | Carlson et al. | 427/166 |
| 4,140,814 | 2/1979 | Hynecek | 427/166 |
| 4,654,559 | 3/1987 | Hinotani et al. . | |
| 4,747,674 | 5/1988 | Butterfield | 350/399 |
| 4,945,282 | 7/1990 | Kawamura et al. | 313/479 |
| 5,025,490 | 6/1991 | Tamura . | |
| 5,051,652 | 9/1991 | Isomura et al. | 313/479 |
| 5,248,915 | 9/1993 | Tong et al. | 313/478 |
| 5,254,904 | 10/1993 | Van de Leest . | |
| 5,281,365 | 1/1994 | Sohn et al. | 427/64 |
| 5,300,315 | 4/1994 | Prando et al. | 427/64 |
| 5,334,409 | 8/1994 | Sohn et al. | 427/64 |

FOREIGN PATENT DOCUMENTS

| | | |
|---|---|---|
| 0145201 | 6/1985 | European Pat. Off. . |
| 568702 | 11/1993 | European Pat. Off. . |
| 4135448 | 5/1992 | Germany . |
| 63-76247 | 4/1988 | Japan . |
| 2280101 | 11/1990 | Japan . |
| 3238740 | 10/1991 | Japan . |
| 9309559 | 5/1993 | WIPO . |

OTHER PUBLICATIONS

"Combined Antistatic and Antireflection . . . ", H. Kawamura, et al., SID 1989 Digest; pp. 270–273 (no mo.).

*Primary Examiner*—Janyce Bell

[57] ABSTRACT

A cathode ray tube includes a face plate on which are formed a first transparent layer which has a high refractive index and is conductive and a second transparent layer which has a low refractive index. Thereby, the reflectance of the outer surface of the face plate can be made low and, at the same time, an antistatic property can be obtained.

7 Claims, 3 Drawing Sheets

METHOD OF PRODUCING A CATHODE-RAY TUBE INCLUDING FIRST AND SECOND TRANSPARENT LAYERS OF HIGH AND LOW REFRACTIVE INDICES FORMED ON A FACE PLATE TO THEREBY LOWER ELECTROMAGNETIC WAVE EMISSION AND REDUCE EXTERNAL LIGHT REFLECTION

This application is a divisional of application Ser. No. 08/070,898, filed on Jun. 3, 1993, now abandoned, the entire contents of which are hereby incoporated by reference.

BACKGROUND OF THE INVENTION

1. Field of the Invention

This invention relates to a cathode-ray tube and a cathode-ray tube producing method. In in particular, it relates to a cathode ray tube (hereinafter referred to as "CRT") which has a double-layered transparent film having anti-reflection, anti-static and electromagnetic-wave-intercepting properties on the outer surface of the face plate, and to a method of producing such a CRT.

2. Description of the Related Art

Due to its operating principle, a CRT requires a high electron-beam acceleration voltage of 20 [kV] or more to be applied to the phosphor screen thereof. With the recent enhancement in luminance and resolution in the CRT, this voltage has been increased. For example, the voltage applied to a CRT for color TV, is as high as 30 [kV] or more. Even with a CRT for display monitors, the voltage applied thereto is 25 [kV] or more. This high voltage level leads to a problem in that the electric charge on the outer surface of the face plate of the CRT, forming when the power source for the associated set is turned ON/OFF, causes a discharge phenomenon when the viewer approaches the face plate. This phenomenon may cause the viewer to experience an unpleasant sensation or, in some cases, even a shock.

To prevent such a phenomenon, various measures have conventionally been taken. For example, a coating having a surface resistance value of $10^9$ Ω/□ (hereinafter given simply as "Ω") is provided on the face plate surface. Alternatively a glass panel with conductive films having a surface resistance value of approximately $10^9$Ω is glued to the face plate surface by means of a UV (ultraviolet) curing resin having substantially the same refractive index as this glass panel. A portion of these conductive films is grounded through a metal explosion-proof band wound around the face plate, thereby allowing the charge to escape.

FIG. 5 schematically illustrates the antistatic mechanism of an antistatic-processed CRT. Referring to FIG. 5, a conductive film with an uneven surface or a glass panel 2 with a conductive film is provided on the surface of a face plate section 3 of a CRT 1. Further, and a conductive paste 8 is provided along the periphery of the conductive film or the glass panel 2 with a conductive film. The CRT 1 is equipped with an explosion-proof metal band 9, to which a mounting lug 10 is attached. A grounding line 11 is connected to this mounting lug 10. The conductive film or the glass panel 2 with a conductive film is connected to the ground 12 through the conductive paste 8, the explosion-proof metal band 9, the mounting lug 10 and the grounding line 11 so that the surface charge of the CRT can be constantly connected to the ground 12, i.e., grounded.

In FIG. 5, numeral 4 indicates a funnel section of the CRT. The CRT 1 has a high-voltage button 5, which is connected through a lead wire 5*a* to a high-voltage power source (not shown). A neck section 6 of the CRT contains an electron gun (not shown), which is connected through a lead wire 6*a* to a drive power source (not shown). A deflecting yoke 7, which is provided adjacent to the neck section 6, is connected through a lead wire 7*a* to a deflection power source (not shown).

In this CRT, constructed as described above, an electron beam emitted from the electron gun, provided in the neck section 6, is electromagnetically deflected by the deflecting yoke 7, and a high voltage is applied through the high-voltage button 5 to a phosphor surface provided on the inner side of the face plate section 3. This thereby accelerates the electron beam, the energy of which excites the phosphor surface and causes it to emit light, whereby a light output is obtained.

As stated above, under the influence of the high voltage applied to the phosphor surface on the inner side of the face plate section, an electric charge is generated on the outer surface of the face plate section 3 when the power is turned ON/OFF. Thus, the viewer approaching the face plate section 3 may experience an unpleasant sensation or a shock. Further, this electric charge causes fine dust, etc. in the air to adhere to the outer surface of the face plate section 3 to make the surface conspicuously dirty, thereby impairing the quality of the display image.

To eliminate such problems, a conductive coating has conventionally been provided on the outer surface of the face plate section 3 or, as shown in FIG. 5, the glass panel 2 with a conductive film has been glued to the outer surface of the face plate section 3 by means of a UV (ultraviolet) curing resin having substantially the same refractive index as the glass panel, the surface charge being constantly allowed to escape to the ground by connecting the conductive film to the ground 12. A surface resistance value of $10^9$Ω is sufficient for the conductive film of such an antistatic-processed CRT. In view of this, a coating material using an antimony-containing tin oxide ($SnO_2$:Sb) as the filler has been used.

A CRT generally has another problem in that external light is reflected by the face plate thereof, thereby making the display image rather hard to see. As a means for solving this problem, a measure has conventionally been taken according to which an uneven surface configuration is imparted to the above transparent conductive film, thereby causing the light incident on the surface of the face plate to undergo irregular reflection. Due to this uneven surface configuration, not only the external light incident on the face-plate surface, but also the light emitted from the phosphor surface undergoes irregular reflection, resulting in a deterioration in the resolution of the display image.

Further, the glass panel 2 with a conductive film is usually composed of four optical thin films (of which the lowest layer is the conductive film). These four thin films, which have different refractive indexes, are formed by evaporation, alternately arranging them, for example, as follows: high-refractive-index-film/low-refractive-index-film/high-refractive-index-film/low-refractive-index-film, whereby a reduction in the surface reflectance is prevented. Since these optical thin films are smooth films formed by evaporation, they do not interfere with the quality of the display image as does the film with an uneven surface configuration, but use of them leads to an increase in material and production costs. Further, the UV (ultraviolet) curing resin used for the purpose of gluing the glass panel to the face plate section causes an increase in weight.

In recent years, the bad influence of electromagnetic waves on the human body has come to be regarded as a problem. For example, the influence on the human body of the alternating electric field emitted mainly from the deflecting yoke of a display monitor has become a general concern. Due to this problem, standards regarding the electromagnetic waves emitted from display monitors have been established by organizations such as the Swedish National Council for Metrology and Testing (MPR-11) and the Swedish Office Workers Central Organization (TCO). Table 1 shows these standards.

TABLE 1

| Standard | ELF band width 5 Hz ~ 2 kHz | VLF band width 2 kHz ~ 400 kHz | Measurement conditions |
|---|---|---|---|
| MPR-II | 25 V/m or less | 2.5 V/m or less | 50 cm from CRT face 20° C., h. 21% |
| TCO | 10 V/m or less | 1.0 V/m or less | 30 cm from CRT face 20° C., h. 21% |

Generally speaking, the alternating electric field [VLF band width] (2[kHz]~400[kHz]) is emitted mainly from the deflecting yoke. The alternating electric field [VLF band width] on the front surface of an ordinary, non-antistatic-processed CRT and that of an antistatic-processed CRT as described above, are as shown in Table 2. Measurements made by the present inventors have shown that these alternating electric fields [VLF band widths] depend upon the horizontal frequency, it being recognized that the alternating electric field [VLF band width] increases when the horizontal frequency increases.

TABLE 2

| CRT: 16 inch., non-antistatic-processed 16 inch., antistatic finish (surface resistance value: $2.6 \times 10^9$ [Ω] | | | |
|---|---|---|---|
| | | Type of CRT Antistatic-type CRT (untreated CRT) | |
| Measurement method | | MPR-II | TCO |
| Alternating electric field VLF band width (V/m) | Hor. frequency 31 kHz | 2.3 V/m | 5.0 V/m |
| | Hor. frequency 45 kHz | 3.4 V/m | 8.3 V/m |
| | Hor. frequency 64 kHz | 4.8 V/m | 12.0 V/m |

SUMMARY OF THE INVENTION

This invention has been made with a view toward solving the problems in the prior art as described above. It is the object of this invention to provide, at low cost, an anti-static-processed CRT which is capable of attaining a reduction in external-light reflection without causing a deterioration in display-image resolution, and, further, a CRT which is capable of intercepting the alternating electric field of the electromagnetic waves emitted from the display monitor which field is transmitted through the face panel of the CRT to negatively affect the viewer and, in particular, which is capable of intercepting the alternating electric field [VLF band width], and a method of producing such a CRT.

In accordance with this invention, there is provided a cathode ray tube having a face plate, comprising:

a first transparent layer which is formed on an outer surface of the face plate and which has a high refractive index and is conductive; and a second transparent layer which is formed on an outer surface of the first transparent layer and which has a low refractive index.

In accordance with the present invention, there is further provided a method of producing a cathode ray tube, comprising the steps of:

forming a first transparent layer which has a high refractive index and is conductive on an outer surface of a face plate of a cathode ray tube;

curing the first transparent layer; and forming a second transparent layer having a low refractive index on an outer surface of the first transparent layer.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

First Embodiment

Figure 1:
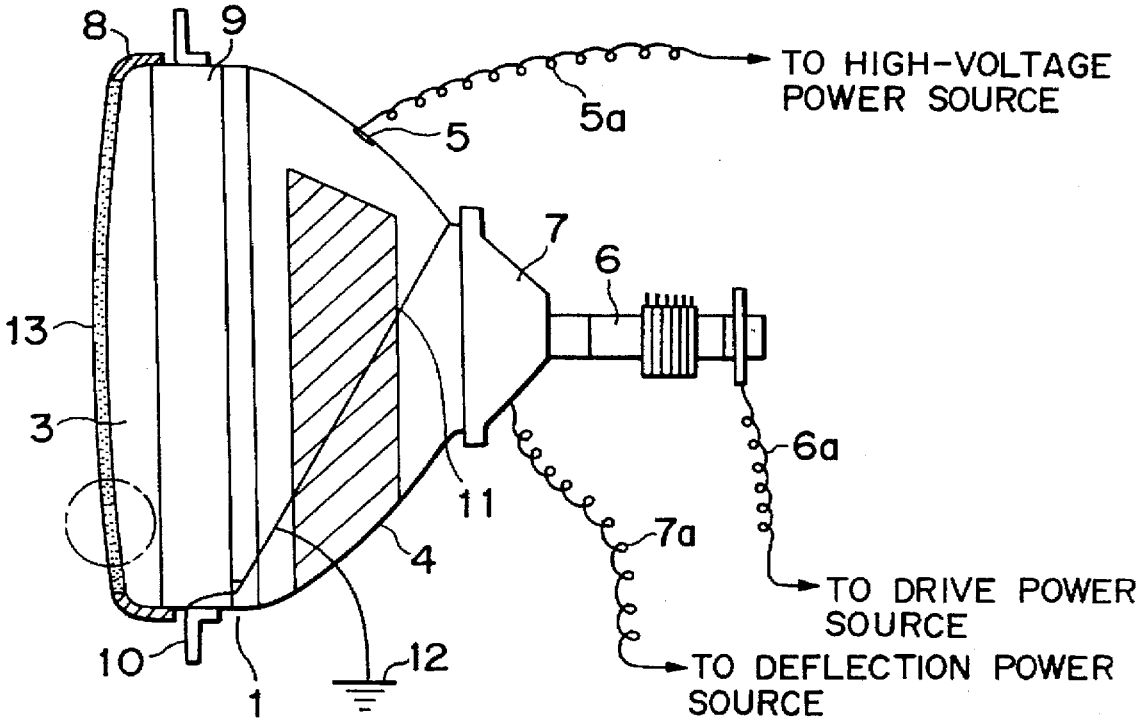
FIG. 1 is a schematic side view showing a cathode ray tube according to a first embodiment of this invention.
Figure 2:
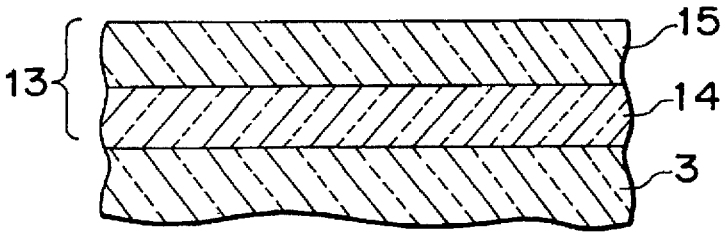
FIG. 2 is an enlarged sectional view of a double-layered coating.

An embodiment of this invention will now be described with reference to the drawings. FIG. 1 is a schematic side view of a cathode ray tube according to the first embodiment of this invention. Referring to FIG. 1, a double-layered coating 13 is formed on the surface of a face plate section 3. As shown in the enlarged sectional view of FIG. 2, the first layer of the double-layered coating 13, positioned closer to the face plate section 3 than the second layer, is formed as a first transparent layer 14 which has a high refractive index and is conductive and in which ultra-fine particles of indium oxide ($In_2O_3$) are dispersed. The second layer of the double-layered coating 13 is formed as a second transparent layer 15 of silica having a low refractive index. The first, highly refractive transparent conductive layer 14 is formed by applying an alcohol solution of Si (silicon) alkoxide with —OH and/or —OR groups, wherein R is an alkyl group, which contains ultra-fine particles of indium oxide ($In_2O_3$) in a dispersed state, to the face plate section 3 by spin application, and then allowing the applied solution to dry or cure. The second, transparent layer 15, having a low refractive index, is formed by applying an alcohol solution of Si (silicon) alkoxide with —OH and/or —OR groups to the surface of the first layer by spin application and then effecting drying or curing (baking) of the applied solution.

Figure 5:
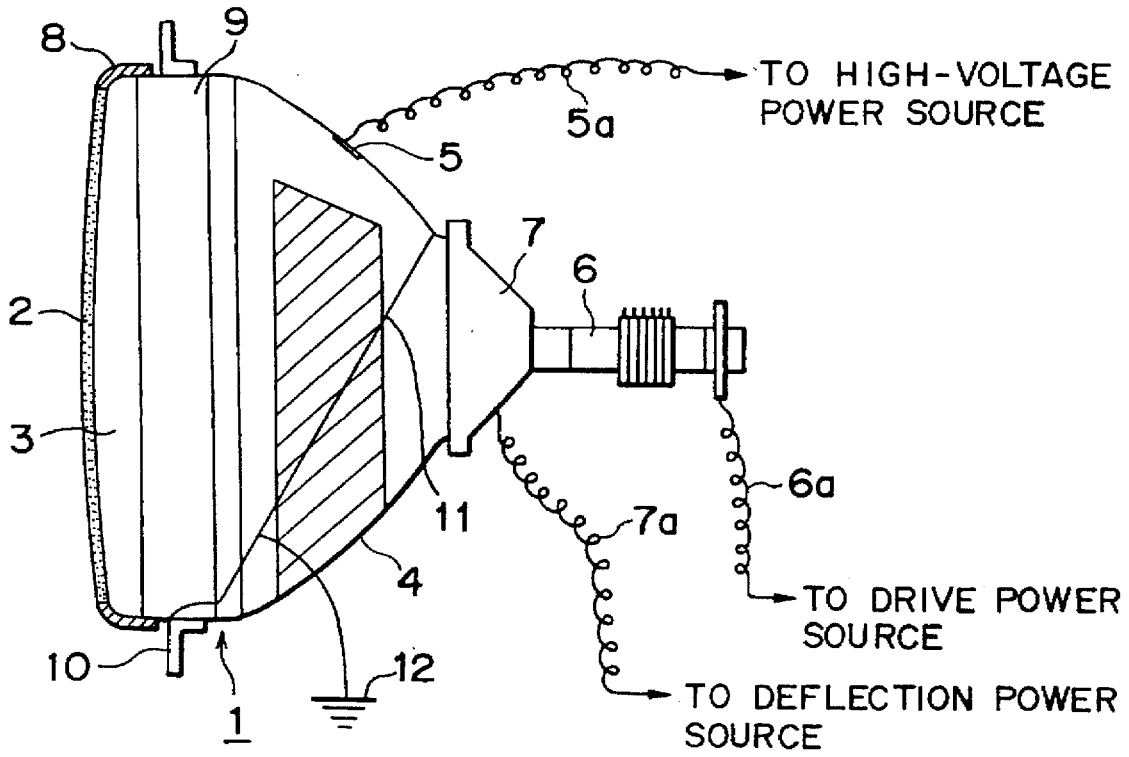
FIG. 5 is a schematic side view showing a conventional cathode ray tube.

The other components of this embodiment, which are indicated by the same reference numerals as those of the conventional example of FIG. 5, are the same as those in the prior art, so a description thereof will be omitted.

Figure 3:
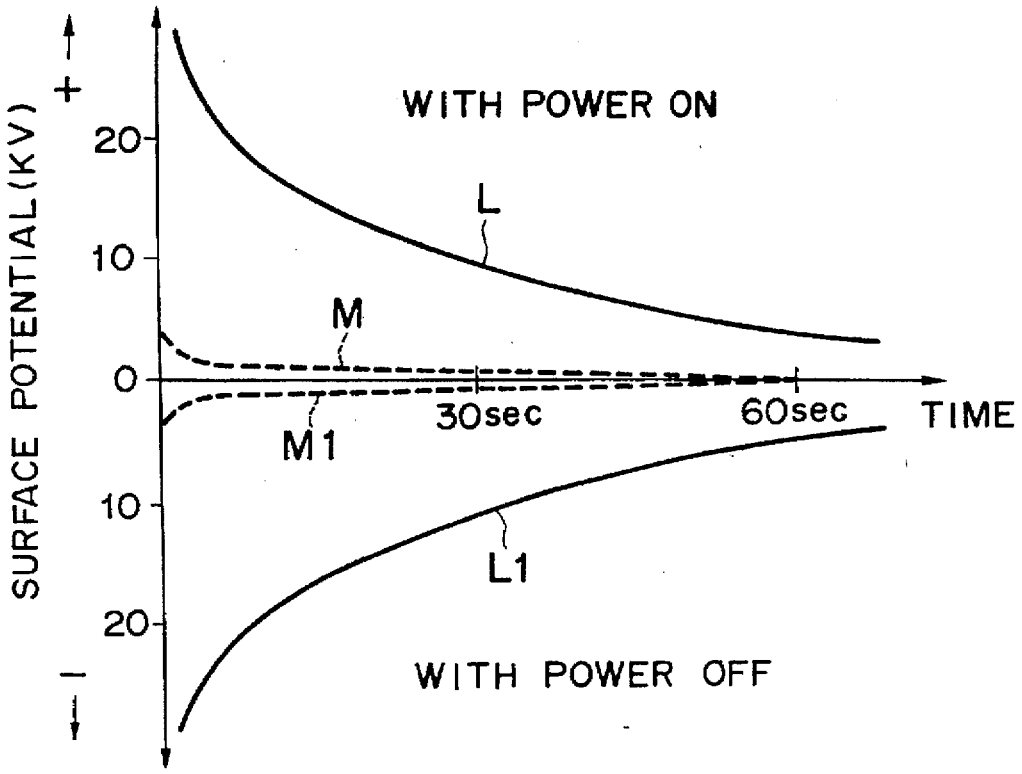
FIG. 3 is a diagrammatic view showing the surface potentional attenuation characteristics in the first embodiment of this invention.

The surface resistance value and the refractive index of the first, highly refractive transparent conductive layer 14 can be varied by adjusting the dispersion density of the ultra-fine particles of indium oxide ($In_2O_3$). When the surface resistance value of the double-layered coating 13 is $1.2\times10^5\Omega$, the characteristic curves M and M1 represented by the broken lines of FIG. 3 indicate changes in the electric charge on the outer surface of the face plate section 3 when the power is ON and OFF, respectively. Thus, a reduction in electric charge more substantial than that of the characteristic curves L and L1 of the non-antistatic-processed CRT can be realized by this embodiment.

Figure 4:
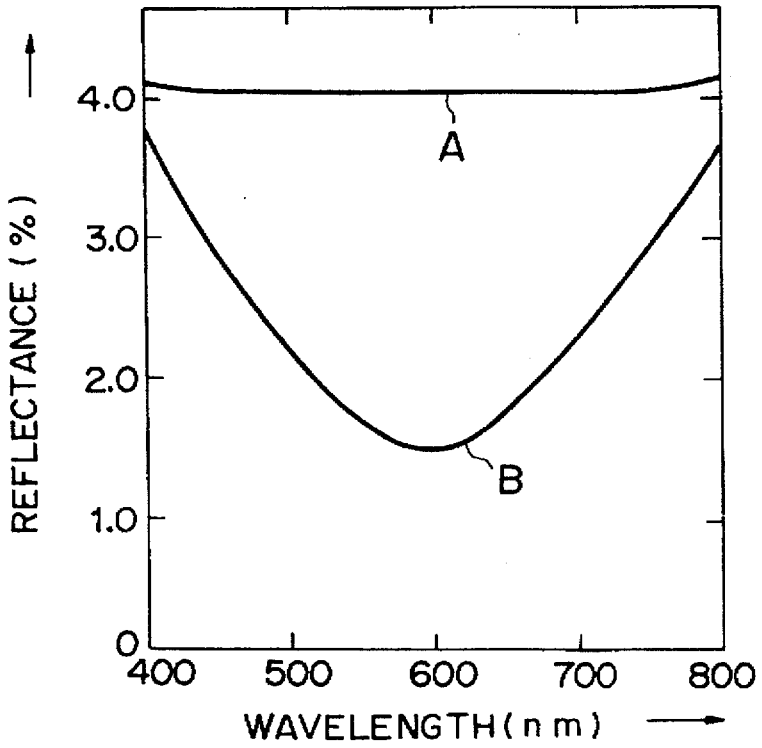
FIG. 4 is a diagrammatic view showing the surface reflection spectrum in the first embodiment of this invention.

The surface reflection spectrum of the first embodiment is as shown in FIG. 4. While the characteristic curve (A) of the non-antistatic-processed CRT indicates a surface reflectance of a little over 4%, the characteristic curve (B) of the CRT having the double-layered coating 13 indicates a minimum surface reflectance of 1.5%. This provides which means a reduction to substantially ⅓, thus realizing a substantial reduction in external light reflection, whereby it is made possible to restrain reflection of external light without causing a deterioration in the resolution of the display image.

Since the transparent conductive layer 15 having a low refractive index is a pure silica film containing no foreign matters, it also serves as a sort of overcoating for the first layer when it is baked at a temperature of 150° C. or more. No damage was inflicted on this layer with a pencil having a JIS hardness of 9H, nor was it worn by applying a plastic eraser 50 times or more thereto, thus enabling a double-layered coating layer 13 which has a very high level of film strength to be provided.

Second Embodiment:

The double-layered coating 13 of the second embodiment has the same construction as that of the first embodiment, except that the first, highly refractive transparent conductive layer 14 is formed from tin oxide ($SnO_2$) by CVD (chemical vapor deposition). As in the first embodiment, it is possible to vary the surface resistance value, refractive index, etc. by adjusting the deposition film thickness. When the surface resistance value is set at the same level as in the first embodiment, the antistatic effect, electric-field intercepting effect, etc. remain the same, with the surface reflectance also being approximately the same.

Third Embodiment:

Table 3 shows the results of alternating-field [VLF band width] measurements when a CRT was used at a horizontal scanning frequency of 64 [kHz]. With the surface resistance value of the double-layered coating 13 of $1.2\times10^5\Omega$, the standards of Table 1 cannot be satisfied.

TABLE 3

Horizontal scanning frequency: 64 [kHz]

| | MPR II (V/m) | TCO (V/m) |
|---|---|---|
| Standard (Measured Distance) | 2.5 (50 cm) | 1.0 (30 cm) |
| First Embodiment | 4.0 | 11.4 |

In this third embodiment, a surface resistance value of $4.5\times10^3\Omega$ is imparted to the highly refractive, transparent conductive layer 14. When the CRT is used at a horizontal scanning frequency which is not less than 30 [kHz] and less than 45 [kHz], it is possible to realize a desired electric-field intercepting effect. Table 4 shows the results of alternating-field [VLF band width] measurements when the surface resistance value was $4.5\times10^3\Omega$ and the horizontal scanning frequency was 31 [kHz]. It can be seen from this table that this embodiment provides a satisfactory electric-field intercepting effect.

TABLE 4

Horizontal scanning frequency: 31 [kHz]

| | MPR II (V/m) | TCO (V/m) |
|---|---|---|
| Standard (Measured Distance) | 2.5 (50 cm) | 1.0 (30 cm) |
| Third Embodiment | 0.284 | 0.5 |

Fourth Embodiment:

In the fourth embodiment, a surface resistance value of $3.0\times10^3\Omega$ is imparted to the highly refractive transparent conductive layer 14. When the CRT is used at a horizontal scanning frequency which is not less than 45 [kHz], it is possible to realize a desired electric-field intercepting effect. Table 5 shows the results of alternating-field [VLF band width] measurements. It can be seen from this table that this embodiment provides a satisfactory electric-field intercepting effect.

TABLE 5

Horizontal scanning frequency: 64 [kHz]

| | MPR II (V/m) | TCO (V/m) |
|---|---|---|
| Standard (Measured Distance) | 2.5 (50 cm) | 1.0 (30 cm) |
| Fourth Embodiment | 0.65 | 0.86 |

Fifth Embodiment:

While in the first embodiment the second transparent layer 15 having a low refractive index was formed after forming the first, highly reflective transparent conductive layer 14 on the surface of the face plate section 3, it is also possible to augment the adhesion strength between the first and second layers by effecting curing, for example, for 10 minutes at 150° C. after the formation of the first layer, thereby enabling a stronger double-layered coating 13 to be provided which is free from a damage looking like a flaw and attributable to a relative displacement of the first and second layers caused by external impacts, etc.

Sixth Embodiment:

While in the first embodiment the first, highly refractive transparent conductive layer 14 was formed by applying an alcohol solution of Si (silicon) alkoxide with —OH and/or —OR groups which contained ultra-fine particles of indium oxide ($In_2O_3$) in a dispersed state, to the face plate section, it is also possible to form a film from ultra-fine particles of binderless indium oxide ($In_2O_3$) without using silicon (Si) alkoxide. Further, it is also possible to use an alcohol solution of a metal element such as tantalum (Ta), titanium (Ti) or zirconium (Zr) and of an organic compound as the base coating material for forming the highly refractive transparent conductive film having a low resistance.

As described above, in accordance with this invention, a double layered coating consisting of a highly refractive, transparent conductive layer and a transparent layer having a low refractive index is formed on the outer surface of the face plate of a CRT, thereby enabling a CRT to be provided which is capable of restraining external light reflection without causing a deterioration in the display-image resolution and which is endowed with antistatic and electromagnetic-wave-intercepting properties.

By making the surface resistance value of the double-layered coating low, a CRT can be obtained which can effectively intercept the [VLF band width] alternating electric field.

Further, by effecting curing after the formation by application of the highly refractive, transparent conductive film, it is possible to form a strong double-layered coating resistant to external damages.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of producing a cathode ray tube, comprising the steps of:

forming a first transparent layer on an outer surface of a face plate of a cathode ray tube by applying an alcohol solution of a silicon alkoxide with —OH and/or —OR groups, wherein R is an alkyl group, which contains ultra-fine particles of indium oxide in a dispersed state to the outer surface of the face plate and curing said alcohol solution, said first transparent layer having a high refractive index and being conductive; and forming a second transparent layer having a low refractive index on an outer surface of the first transparent layer by applying an alcohol solution of a silicon alkoxide with —OH and/or —OR groups, wherein R is an alkyl group, to the outer surface of the first transparent layer;

said first transparent layer having a surface resistance value which reduces an alternating electric field emitted from the face plate of the cathode ray tube.

2. A method according to claim 1, wherein the surface resistance value of said first transparent layer is less than a surface resistance value of said first and second transparent layers combined.

3. A method according to claim 1, wherein the step of forming the second transparent layer further includes curing the alcohol solution on the outer surface of the first transparent layer.

4. The method of claim 1 wherein, in the first transparent layer, the density of the particles of indium oxide dispersed in the alcohol solution is varied to vary the surface resistance to a desired value.

5. A method of producing a cathode ray tube comprising the steps of:

forming a first transparent layer having a high refractive index and being conductive on outer surface of a face plate of a cathode ray tube including chemical vapor depositing tin oxide; and forming a second transparent layer having a low refractive index on an outer surface of the first transparent layer including applying an alcohol solution of a silicon alkoxide with —OH and/or —OR groups, wherein R is an alkyl group, to the outer surface of the first transparent layer;

said first transparent layer having a surface resistance value which reduces an alternating electric field emitted from the face plate of the cathode ray tube.

6. A method according to claim 5, wherein the step of forming the second transparent layer further includes curing the alcohol solution on the outer surface of the first transparent layer.

7. A method according to claim 5, wherein the step of forming said first transparent layer includes adjusting a film thickness of said first transparent layer until said surface resistance value is obtained.

* * * * *